US005323087A

United States Patent [19]

Zaslavsky et al.

[11] Patent Number: 5,323,087

[45] Date of Patent: Jun. 21, 1994

[54] ULTRAVIOLET RADIATION STARTING SOURCE AND LAMP CONTAINING SAME

[75] Inventors: Gregory Zaslavsky, Marblehead; Joseph V. Lima, Salem, both of Mass.

[73] Assignee: GTE Products Corporation, Danvers, Mass.

[21] Appl. No.: 979,140

[22] Filed: Nov. 20, 1992

[51] Int. Cl.[5] ..... H01J 7/44

[52] U.S. Cl. ..... 315/60; 315/344; 315/59; 313/331; 313/631

[58] Field of Search ..... 315/344, 58, 73, 60, 315/248, 59; 445/53, 9; 313/331, 631, 632, 622

[56] References Cited

U.S. PATENT DOCUMENTS

| | | | |
|---|---|---|---|
| 3,226,597 | 9/1963 | Green . | |
| 3,900,761 | 8/1975 | Freese et al. | 315/60 |
| 4,041,352 | 8/1977 | McNeill et al. | 315/248 |
| 4,053,814 | 10/1977 | Regan et al. | 315/248 |
| 4,097,777 | 6/1978 | Bacharowski | 315/60 |
| 4,325,004 | 4/1982 | Proud et al. | 315/45 |
| 4,355,261 | 10/1982 | Cohen et al. | 315/47 |
| 4,721,888 | 1/1988 | Proud | 315/60 |
| 4,818,915 | 4/1989 | Zaslavsky et al. | 315/60 |
| 4,987,344 | 1/1991 | Zaslavsky et al. | 315/59 |
| 5,258,687 | 11/1993 | Duggan et al. | 313/631 X |

*Primary Examiner*—Robert J. Pascal
*Assistant Examiner*—Haissa Philogene
*Attorney, Agent, or Firm*—Carlo S. Bessone

[57] ABSTRACT

An ultraviolet radiation starting source for an arc discharge lamp includes a sealed envelope with a press seal, a gaseous fill material within the envelope, a molybdenum ribbon which extends from the press seal into the interior region of the envelope and a wire inlead for carrying electrical energy to the ribbon. A method of manufacture is described in which fill material flows through a tube. A press seal is formed at one end of the tube, the interior of the tube is pumped to a desired pressure and another press seal is formed at the second end of the tube to create a sealed envelope.

6 Claims, 4 Drawing Sheets

ULTRAVIOLET RADIATION STARTING SOURCE AND LAMP CONTAINING SAME

BACKGROUND OF THE INVENTION

This invention relates to an ultraviolet radiation starting source, or ultraviolet (UV) enhancer, for a metal vapor arc discharge lamp.

High pressure metal halide arc discharge lamps typically comprise an arc tube which encloses an ionizable fill material and two electrodes at opposing ends of the tube. To reduce the time it takes to start the lamp, a starter electrode may be disposed inside the arc tube near one of the main electrodes, as shown in Freese et. al., U.S. Pat. No. 3,900,761. A discharge can be initiated between the starter electrode and one of the main electrodes at a voltage that is much lower than the voltage required to ignite an arc between the two main electrodes. The ultraviolet radiation and plasma from this discharge enhance discharge formation in the arc tube between the two main electrodes.

Zaslavsky et. al., U.S. Pat. No. 4,818,915, issued Apr. 4, 1989, discloses a UV enhancer which is separate from the arc tube. The '915 patent, which is incorporated herein by reference, describes a UV enhancer which typically has a borosilicate glass envelope enclosing an ionizable fill material and a single electrode. The single electrode has a getter which removes certain gases when the envelope heats and outgasses. These gases, particularly oxygen, hydrogen, and nitrogen, contaminate the fill material. When energized, the UV enhancer produces ultraviolet radiation which illuminates the path between the main electrodes within the arc tube, thus decreasing the time for generating a high intensity arc discharge.

The use of a getter increases the number of components in the UV enhancer, limits how small the UV enhancer can be made, and limits the operation of the UV enhancer to a particular temperature range. With a getter, the UV enhancer is sensitive to location within the lamp because of outgassing and the getter temperature range. Because of these size and location requirements, a UV enhancer with a getter cannot be used for all applications, such as double-ended lamps which have a small diameter outer envelope.

A typical process for making a UV enhancer begins with fabricating an electrode assembly which is inserted into a tube. The electrode assembly typically has a number of welded parts. As described in the '915 patent, an electrode assembly may include a moly foil which is welded to a rod and to an outer lead. The rod supports a getter, and the outer lead is coupled to a main electrode. Since the parts are welded, it can be difficult to produce UV enhancers with an automated system. Electrode assemblies are fabricated first, then manually loaded onto trays.

It is an object of the present invention to provide an improved UV enhancer.

It is another object of the present invention to provide a simplified method for manufacturing a UV enhancer.

It is yet another object of the present invention to provide a UV enhancer with fewer components then prior art devices.

It is still another object of the present invention to provide a UV enhancer which operates under a broad range of conditions.

SUMMARY OF THE INVENTION

These objects are achieved in one aspect of the invention in an ultraviolet radiation starting source for an arc discharge lamp which comprises a sealed ultraviolet transmissive envelope enclosing a fill material which supports an ultraviolet emitting discharge. The sealed envelope has at least one press seal and an interior region. A conductive ribbon extends from the press seal into the interior region of the envelope. A wire inlead carries electrical energy to the conductive ribbon.

In a preferred embodiment, the fill material comprises argon, and the conductive ribbon comprises molybdenum.

In another aspect of the invention, a method for making an ultraviolet radiation starting source for an arc discharge lamp comprises passing a gaseous fill material through a tube which has a first end, a second end, and an interior region; inserting conductive a ribbon and a wire inlead into first end; forming a first press seal at the first end so that the ribbon extends into the interior region of the tube and the wire inlead extends to the exterior of the sealed tube; pumping from the second end of the tube to create a desired pressure within the tube; and forming a second seal at the second end of the tube to produce a sealed envelope enclosing the fill material and the ribbon.

In a preferred embodiment, the seal forming steps each comprise forming a press seal. The invention may also comprise the steps of obtaining a remaining portion of the tube after the second seal has been formed and after the sealed envelope is removed, introducing a molybdenum ribbon and a wire inlead into an open end of the remaining portion, and forming a seal at the open end to form a second sealed envelope.

In yet another aspect of the invention, a metal vapor arc discharge lamp comprises a sealed arc tube which encloses a first fill material and two electrodes; an ultraviolet radiation starting source comprising an ultraviolet-transmissive sealed envelope, a second fill material within the sealed envelope, a molybdenum ribbon extending from the press seal into the interior region of the sealed envelope, and a wire inlead for carrying electrical energy to the ribbon; an outer light-transmissive envelope enclosing the arc tube and the UV source; and a means for coupling electrical energy to the two electrodes of the arc tube and to the UV source.

The UV source of the present invention is relatively inexpensive and easy to produce compared to prior art UV sources. The conductive ribbon is used in the press seal to create a hermetic seal, and as an electrode. The source may be produced so that the only materials within the envelope are the gaseous fill material and the molybdenum ribbon. Fewer parts are necessary, no getter is used, no mercury is needed, and the UV enhancer can be made smaller than prior art devices.

BRIEF DESCRIPTION OF THE DRAWINGS

For a better understanding of the present invention together with other and further objects, advantages, and capabilities thereof, references made to the accompanying drawings which are incorporated herein by reference and in which.

DESCRIPTION OF THE PREFERRED EMBODIMENTS

Figure 1:
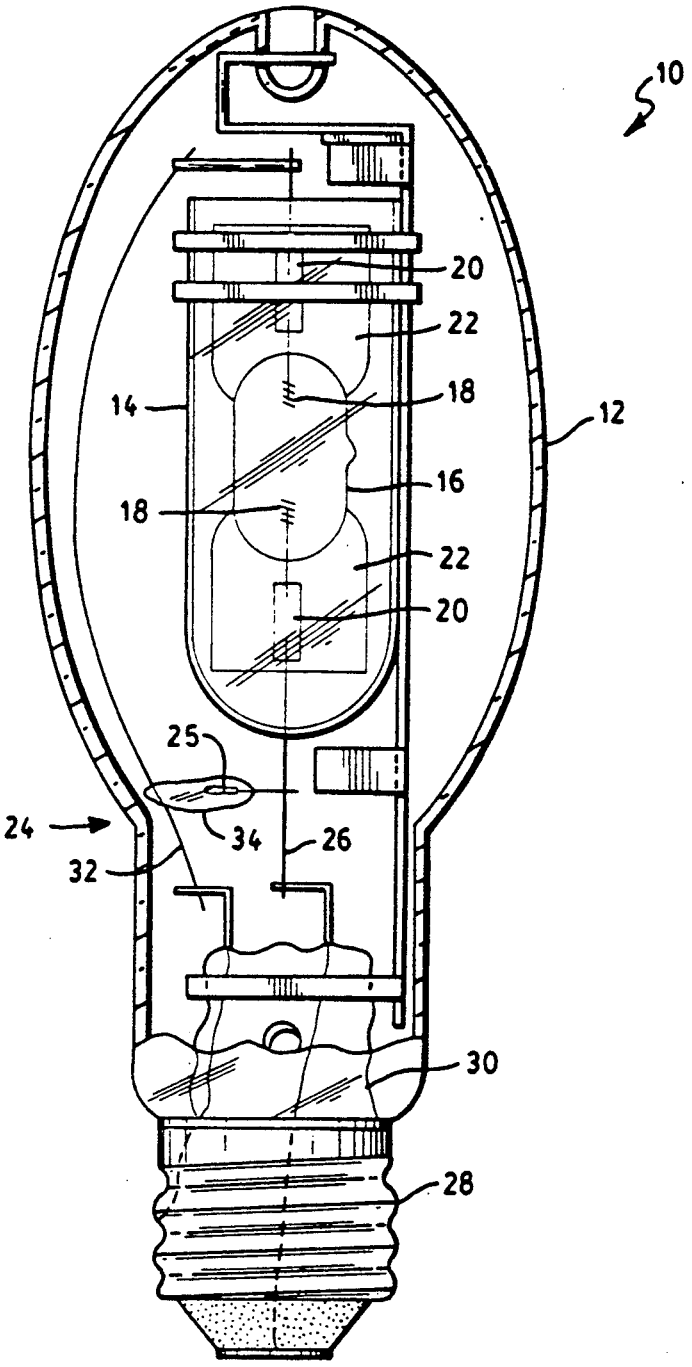
FIG. 1 PRIOR ART
FIG. 1 is a cross-sectional view of a prior art metal halide lamp.

A prior art metal halide arc discharge lamp 10 is shown in FIG. 1. A sealed envelope 12 encloses a cylindrical quartz sleeve 14. The sleeve 14 surrounds an arc tube 16 which encloses two electrodes 18 located at opposite ends of the arc tube and a fill material, e.g., a combination of mercury, metal halides, and argon. Each electrode is coupled to a molybdenum ribbon 20 which is enclosed within a press seal 22 that hermetically seals the arc tube. Electrical energy is coupled from a lamp base 28 through a lamp stem 30 and leads 32 and 26 to the electrodes 18 in the arc tube 16.

A UV enhancer 24 has a sealed envelope 34 that encloses an electrode 25. The electrode 25 is coupled to the lead 26, and is capacitively coupled to the lead 32 which may include a conductor that is helically wrapped around the envelope 34. A typical UV enhancer is about 4.0 mm in diameter and 15.0 to 20.0 mm in overall length. Other details relating to the prior art UV enhancer 24 are discussed in the '915 patent identified above.

Figures 2A, 2B, 2C, 2D:
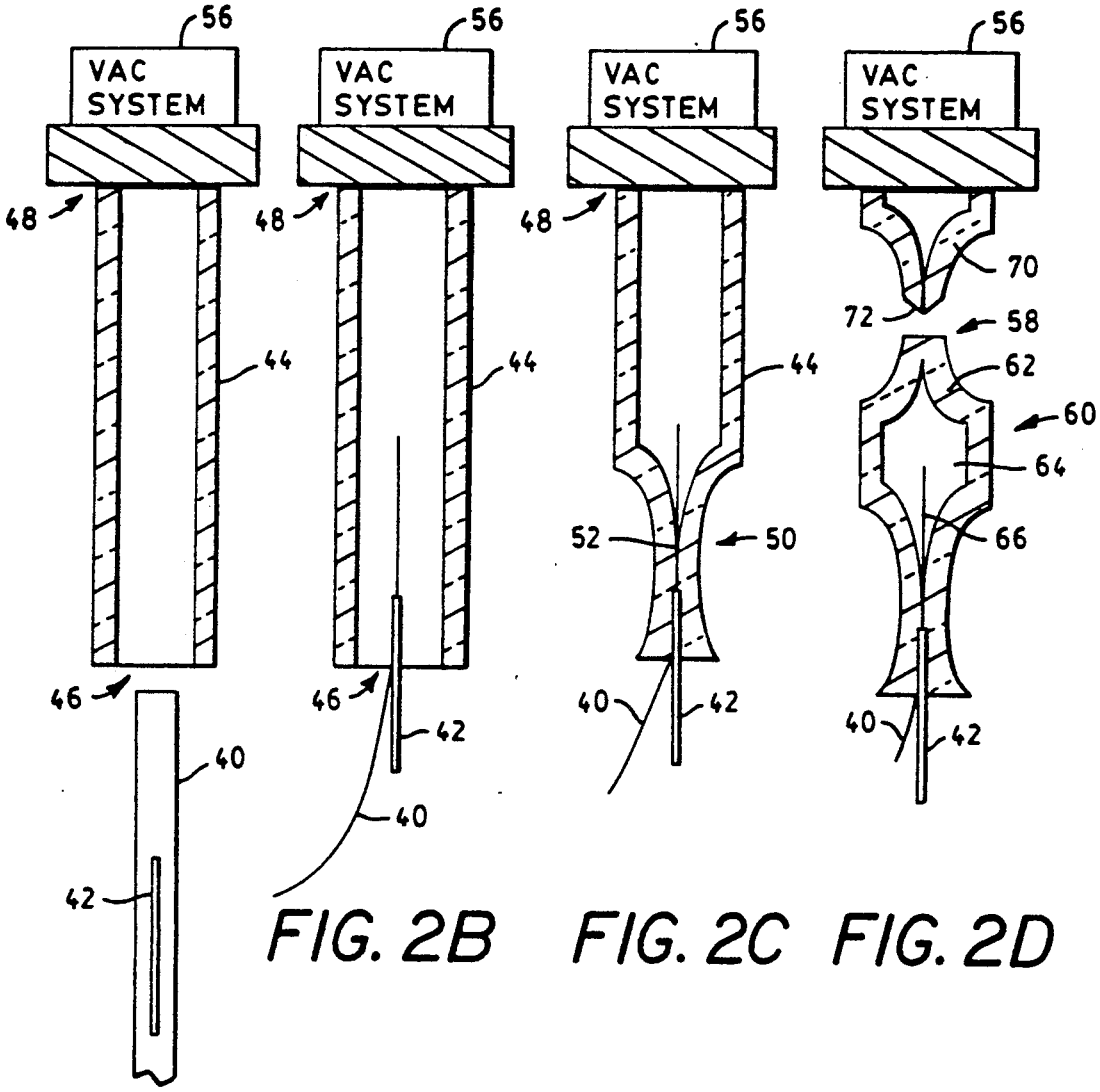
FIGS. 2(*a*)–2(*d*) illustrate the steps to produce a UV enhancer according to the present invention.

FIGS. 2(*a*)–2(*d*) represent the steps to produce a UV enhancer according to the present invention. Referring to FIG. 2(*a*), a molybdenum ribbon 40 and a nickel wire 42 are positioned at a lower end 46 of a cylindrical quartz tube 44. The ribbon and wire are placed together, without being bonded to each other, and are inserted into the lower end 46 of tube 44. When inserted, the ribbon 40 extends further into the interior of the tube 44 than the wire 42, as shown in FIG. 2(*b*). The ribbon 40 has sharp edges which are produced by rollers. These edges provide high electric field concentration, which results in reliable breakdown.

A fill material, such as argon, is introduced into an upper end 48 of the tube and flows downwardly through the tube and out lower end 46. A press seal 50 is formed in the lower portion of the tube 44 by heating the tube and pressing the lower end together (FIG. 2(*c*)), a technique well known in the art. Referring to FIG. 2(*d*), coupled to the tube at upper end 48 is a vacuum system 56 which reduces the pressure in the tube down to a desired level, such as 5–20 Torr. The vacuum system 56 may be coupled to the tube after the first seal is pressed, or it may be coupled during the entire process and activated only when needed to reduce pressure. A second press seal 58, (shown as part of remaining tube in FIG. 2(*d*)) is formed at the upper end of tube 44.

The resulting UV enhancer 60 comprises a sealed envelope 62 which encloses a fill material 64, typically argon, and a strip 66 of molybdenum ribbon which is hermetically sealed within the envelope 62. The wire 42 is located in a portion of the press seal area so as to maintain electrical contact with the ribbon 40, but is outside the interior of the sealed envelope 62.

Figure 3A:
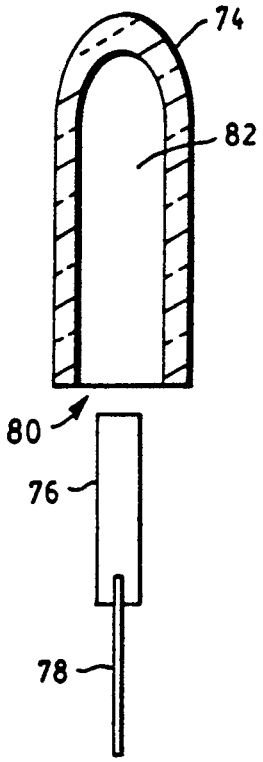
FIGS. 3(*a*)–3(*c*) illustrate the steps to produce a UV enhancer according to another embodiment of the present invention.
Figure 3B:
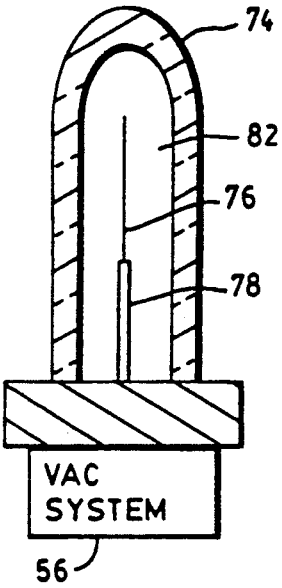
Figure 3C:
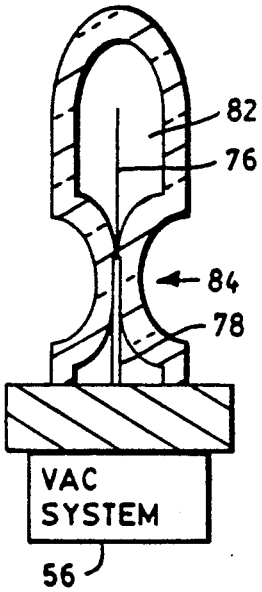

A second press seal 72 closes one end of a remaining portion 70 of tube 44. Referring to FIG. 3(*a*), a second molybdenum ribbon 76 and a wire 78 are positioned at an open end 80 of a dome 74, which corresponds to remaining portion 70. The vacuum system is temporarily removed, and the ribbon and wire are positioned in the interior 82 of dome 74. The vacuum system 56 reduces the pressure within dome 74 (FIG. 3(*b*)), and press seal 84 is formed at the lower end of the dome (FIG. 3(*c*)). This process results in a second UV enhancer similar to UV enhancer 60.

Figure 4:
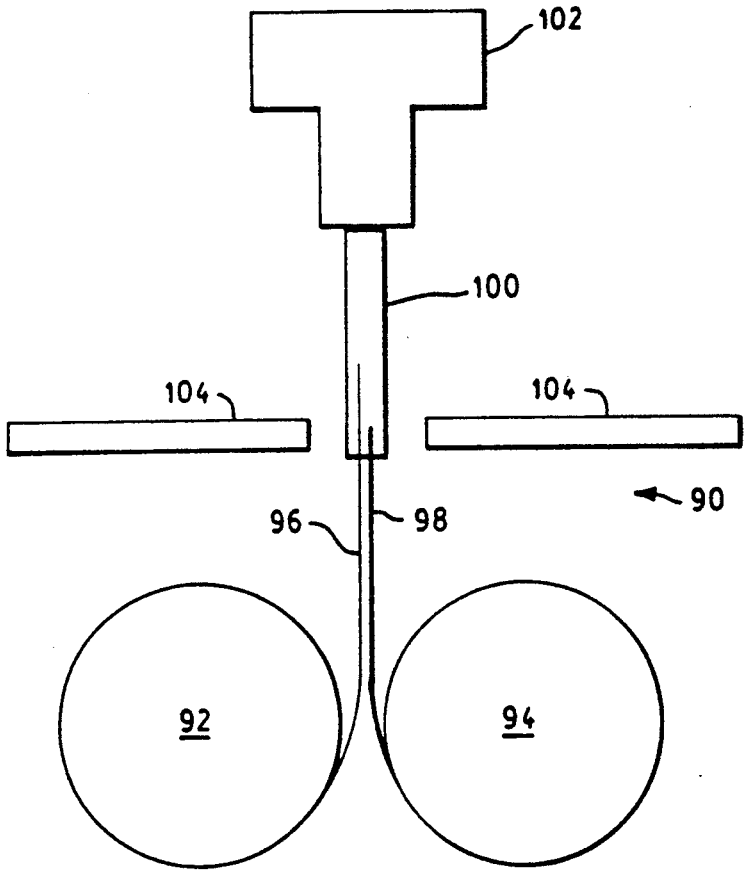
FIG. 4 is a pictorial representation of an apparatus for producing a UV enhancer according to the present invention.

Referring to FIG. 4, an automatic feeding system 90 includes moly ribbon spool 92 and wire spool 94. These spools hold lengths of ribbon 96 and wire 98, and feed predetermined lengths them together into quartz tube 100 when they are rotated a desired amount. The quartz tube 100 may be positioned with its upper end in an exhaust tube 102 (part of the vacuum system). Adjacent to a lower end of the tube are press feet 104 which form a press seal. In operation, the spools feed the ribbon and wire into the tube, press feet 104 form a press seal as represented in FIGS. 2(*c*) and 3(*c*), and the ribbon and wire are cut below the seal. The interior of the tube 100 is then pumped, and a press seal is formed at the upper end to finish the UV enhancer. The ribbon and the wire are unattached prior to formation of a seal. After formation of a seal, the tube material urges the wire and the ribbon into contact, thereby forming a reliable electrical connection without requiring welding or other bonding techniques. Another tube is loaded into exhaust tube 102 and the procedure is repeated. The wire and ribbon are fed without using adhesives or other bonding techniques, such as welding or soldering.

The resulting UV enhancers have been produced with dimensions of about 2.5 mm in diameter and about 10.0 mm long. The moly ribbon is preferably about 0.02 mm to 0.03 mm thick, 1.0 mm wide, and about 4.0 to 7.0 mm long, of which about 2.0 mm to 3.0 mm is within the envelope. The wire has been described as nickel, but other conductors, such as tungsten or molybdenum, may be used, depending on the temperature of the starter electrode and the lamp. The fill material may be substantially only argon, or may include other materials, such as mercury. The tube may be quartz, Vycor, or some other high temperature alumina silicate glass.

Life tests have been performed on samples in which the ribbon and wire were manually fed into the tube without being bonded together. These samples were 25.0 mm in length and 4.0 mm in diameter and had fill pressure of 5–10 Torr. Four samples were tested in an air oven for accelerated testing. For 500 hours, the oven was set to 250° C., and for the next 3864 hours the oven was set to 340° C. No apparent deterioration has been detected. In another test, five 100 watt metal halide lamps were made with UV enhancers as described above. The lamps reached 1560 hours of operation. The starting characteristics were checked every 500 hours. The seals of the UV enhancers remained hermetic, and the discharge was sufficient to provide instant starting.

While there has been shown and described what is at present considered the preferred embodiments of the present invention, it will be obvious to those skilled in the art that various changes and modifications may be made therein without departing from the scope of the invention as defined by the appended claims.

What is claimed is:

1. An ultraviolet radiation starting source for an arc discharge lamp comprising:

a sealed ultraviolet transmissive envelope having at least one press seal and an interior region;

a fill material in the interior region for supporting an ultraviolet emitting discharge within the envelope;

an electrode comprising a conductive ribbon extending from the press seal into the interior region of the envelope; and a wire inlead for carrying electrical energy to said conductive ribbon.

2. A starting source as defined in claim 1 wherein the ribbon comprises molybdenum.

3. A starting source as defined in claim 1 wherein the interior region encloses only the fill material and a portion of the ribbon.

4. A starting source as defined in claim 1 wherein said fill material comprises argon.

5. A starting source as defined in claim 1 wherein said wire inlead extends from said press seal to the exterior of said sealed envelope.

6. A metal vapor arc discharge lamp comprising:

a sealed arc tube including a first fill material and two electrodes;

an ultraviolet radiation starting source comprising a sealed ultraviolet-transmissive envelope having a press seal and an interior region, a second fill material within the envelope, a molybdenum ribbon extending from the press seal into the interior region of the envelope, and a wire inlead for carrying electrical energy to the ribbon;

an outer light-transmissive envelope enclosing the sealed arc tube and the ultraviolet radiation starting source; and a means for coupling electrical energy to the electrodes of the arc tube and to the starting source.

* * * * *